US006770858B2

(12) United States Patent
Schluckebier

(10) Patent No.: US 6,770,858 B2
(45) Date of Patent: Aug. 3, 2004

(54) DEVICE FOR INDUCTIVELY HEATING METALLIC STRIPS

(75) Inventor: Dieter Schluckebier, Simmerath (DE)

(73) Assignee: Otto Junker GmbH, Simmerath (DE)

( * ) Notice: Subject to any disclaimer, the term of this patent is extended or adjusted under 35 U.S.C. 154(b) by 0 days.

(21) Appl. No.: 10/344,630

(22) PCT Filed: Aug. 28, 2001

(86) PCT No.: PCT/DE01/03208

§ 371 (c)(1),
(2), (4) Date: Mar. 18, 2003

(87) PCT Pub. No.: WO02/19773

PCT Pub. Date: Mar. 7, 2002

(65) Prior Publication Data

US 2003/0164372 A1 Sep. 4, 2003

(30) Foreign Application Priority Data

Aug. 29, 2000 (DE) ..... 100 42 454

(51) Int. Cl.[7] ..... H05B 6/10; H05B 6/40

(52) U.S. Cl. ..... 219/645; 219/646; 219/662; 219/670; 219/675; 148/568

(58) Field of Search ..... 219/645, 646, 219/635, 655, 656, 670; 148/567, 568; 266/129

(56) References Cited

U.S. PATENT DOCUMENTS 1,981,631 A * 11/1934 Edwin ..... 219/667
4,258,241 A * 3/1981 Soworowski ..... 219/656
4,595,813 A * 6/1986 Chausse et al. ..... 219/649
4,857,687 A * 8/1989 Andersson et al. ..... 219/646
5,336,868 A * 8/1994 Schluckebier ..... 219/675
5,401,941 A * 3/1995 Mauve et al. ..... 219/645

FOREIGN PATENT DOCUMENTS

DE 35 31 455 * 4/1986

* cited by examiner

*Primary Examiner*—Philip H. Leung
(74) *Attorney, Agent, or Firm*—Jordan and Hamburg LLP

(57) ABSTRACT

For optimum induction heating of metallic strips (1) of differing widths—particularly in the edge region—one multicoil transverse field inductor is positioned both above and below the strip (1) to be heated, whose coil axes are positioned vertically to the strip surface. In this case, each inductor comprises at least one inductor segment (2, 3; 7; 15; 17), which is constructed as a coil composite of multiple approximately rectangular coils (8, 9, 10; 16; 18) which extend predominantly transversely to the transport direction of the strip (1), the coils (8, 9, 10; 16; 18) having different, stepped transverse extensions and the coil having the highest transverse extension extending at most up to the lateral edges of the widest strip and the coil having the lowest transverse extension extending at most up to the lateral edges of the narrowest strip. Each inductor segment (2, 3; 7; 15; 17) is connected to a circuit for defined clocking of its coils (8, 9, 10; 16; 18), and each inductor segment (3; 7; 15; 17) below the strip is assigned an identical inductor segment (2; 7; 15; 17) above the strip. Through the device according to the present invention, overheating of the edges of metal strips (1) is prevented during induction heating—independently of the strip width.

17 Claims, 4 Drawing Sheets

DEVICE FOR INDUCTIVELY HEATING METALLIC STRIPS

DESCRIPTION

Figure 1:
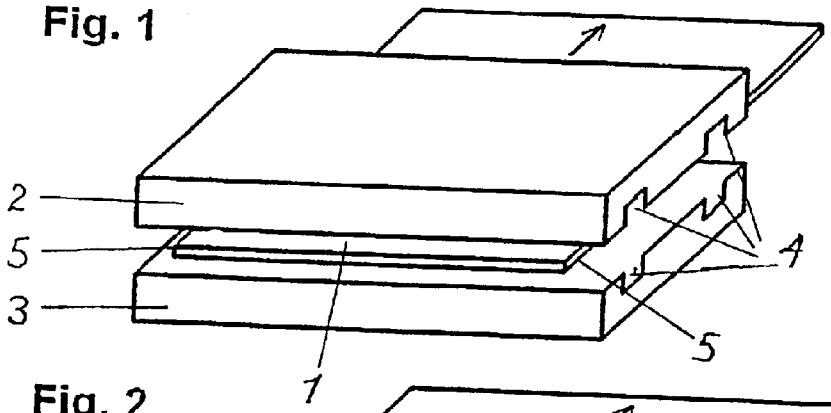

The present invention relates to a device for induction heating of metallic strips of differing widths having one multicoil transverse field inductor both above and below the strip to be heated, whose coil axes are positioned vertically to the strip surface.

A device for induction heating of flat metallic stock, having at least two inductors which are assigned in pairs lying above and below the metal stock, is known from German Patent Application 3928629 A1. In this device, the iron cores of at least one inductor have zigzag or wave-shaped grooves in the transport direction of the stock, into which the conductors are inlaid. The adjustment of the inductor power to the respective strip width is performed essentially by switching off selected coil conductors. An essential disadvantage of this known device is that optimized edge heating of the strips cannot be ensured due to the wound coil conductor course, since for conductors which lie in the edge region of the strip, one part of the conductor is nearer to the edge region of the strip than the other part.

The object of the present invention is thus to implement a device of the type initially cited in such a way that the disadvantages of the known relevant device are avoided, so that in the event of varying stock widths, a uniform heating pattern is achieved over the respective width, and particularly in the edge regions, with simple construction of the inductors.

This object is achieved according to the present invention in a device of the type initially cited in that, for optimized edge heating of the strips, the inductors each comprise at least one inductor segment, which is constructed as a coil composite of multiple approximately rectangular coils, which predominantly extend transversely to the transport direction of the strip, the coils having differing, stepped transverse extensions and the coil having the highest transverse extension extending at most up to the lateral edges of the widest strip and the coil having the lowest transverse extension extending at most up to the lateral edges of the narrow strip. In addition, each inductor segment is connected to a circuit for defined clocking of its coils and each inductor segment below the strip is assigned an identical inductor segment above the strip.

Using the device above, operators of heating devices are capable of treating the greatest possible spectrum of strips—particularly in regard to the strip width, but also in regard to the strip thickness and the material. Through the differing, stepped coils, which may be switched on in a targeted way, the energy consumption is optimized and a uniform heating pattern is achieved independently of the width of the strip used, with maximum temperature oscillations of ±15° C. In this case, the typical heating temperatures are approximately 400° C. for aluminum strips and approximately 500–600° C. for brass strips. The defined clocking of the coil selected for the respective strip width particularly counteracts overheating of the strip edges and therefore prevents warping or other quality losses; in this case, at least one coil may also be switched on permanently within a coil composite in addition to the clocked coils. The coil conductors of the upper inductor segments are switched in the same direction as the coil conductors precisely or approximately opposite below the strip to build up a magnetic field which penetrates the strip uniformly. The division of the inductors into inductor segments and the simple construction of the segments by using approximately rectangular coils reduces the production costs and the susceptibility to breakdown. Should a breakdown nonetheless occur, the affected inductor segment may be replaced individually. A long standstill time and high repair costs are therefore avoided.

The device according to the present invention may further be implemented in such a way that an inductor comprises multiple inductor segments, which are positioned one behind another at intervals in the transport direction of the strip. If there is a lack of space in furnaces which are too short, the inductor segments may also, however, be positioned one directly behind another. Through a divided inductor, the possibility results of switching each segment individually and therefore introducing the respective power necessary separately. Therefore, for example, the segments at the beginning of the heating device, which must heat the still cold stock, may introduce a higher power than the following segments.

The device according to the present invention may further be implemented in such a way that each inductor segment is a coil composite of three to eight coils. A coil composite of three to eight coils per inductor segment is simple to construct and produce. The coils, which are stepped in their transverse extension, have graduations of 4 to 10 cm to each strip side. This distance is selected low enough so that a strip whose edge is not sufficiently heated by the coil lying next to it may be heated optimally by clocking multiple coils.

The device according to the present invention may further be implemented in such a way that the difference of the transverse extension of one coil to the transverse extension of the next smaller or larger coil is at least 50 mm and at most 200 mm. A coil composite stepped in this way allows the operator of a facility to treat strips of different widths. Therefore, he is not only fixed on one strip width, but may heat multiple commercially available strips. If high requirements are placed on the temperature precision, a coil composite having small transverse extension differences must be selected. If the operator wants to treat strips of a width which may not be optimally heated by the coil composite already used in the furnace, he may easily remove the segments in the device and, for example, replace them by segments having coils of smaller transverse extensions and/or transverse extension differences.

The device according to the present invention may further be implemented in such a way that a coil composite is constructed from multiple nesting coils of differing transverse extensions, the coils having a shared axis.

The device according to the present invention may further be implemented in such a way that the coils of a coil composite are placed offset in relation to one another in the transport direction of the strip.

The above arrangements are used for optimizing the temperature distribution, particularly in the edge region of the strip. At the same time, there is the possibility of incorporating inductor segments of differing embodiments within an inductor.

The device according to the present invention may further be implemented in such a way that the coil conductors are positioned above one another or next to one another within a conductor groove. It is additionally possible for only one coil conductor to be in a conductor groove.

The device according to the present invention may further be implemented in such a way that at least two coils per inductor segment, selected as a function of the strip width, are switched in a clocked way so that only one coil is switched on at a time. In this way, for example, 500 or 1000 switching operations per second may be achieved. Through clocking of the coils of this type, overheating of the strip is prevented, particularly in the edge region. However, it is also conceivable to leave one coil continuously switched on, while two other coils are switched in a clocked way. In borderline cases, it may also be advisable to only switch on one coil. The power is provided in this case by one or more converters. The original 100% power of the converter may be relayed via thyristors to the coils of an inductor segment in such a way that, for example, one coil is constantly supplied with 70% of the total power, while two further clocked coils are assigned to receive 10% and 20% of the power, respectively. There is the possibility of clocking the coils of each inductor segment individually within an inductor.

The device according to the present invention may further be implemented in such a way that the frequency and/or duration of the switching operations is variably adjustable for each coil. The use of different frequencies and switching durations for the coils may promote uniform heating over the strip width.

The device according to the present invention may further be implemented in such a way that a scanner is provided to determine the temperature profile over the strip width. Therefore, any unforeseen deviations of the temperature profile, due to defective coils, for example, may be established as rapidly as possible.

The device according to the present invention may further be implemented in such a way that a circuit is provided for automatic clocking of the selected coils by analyzing the temperature profile established by the scanner. In this way, deviations from the intended temperature value are detected immediately. The desired temperature profile may be reached again by changing the clocking.

The device according to the present invention may further be implemented in such a way that at least one upper inductor segment is positioned offset transversely to the transport direction of the strip in relation to the assigned lower inductor segment. In this way, balancing of the temperature profile may be optimized.

The device according to the present invention may further be implemented in such a way that the offset between the upper inductor segment and the assigned lower inductor segment is variably adjustable.

The device according to the present invention may further be implemented in such a way that at least some of the inductor segments are mounted replaceably in the device. In this way, the inductor segments may be removed individually and replaced in case of breakdown. This also applies if strips are to be treated which may not be ideally heated by the inductor segments currently in the furnace due to their width. The furnace may be retrofitted for other strip width ranges through rapid replacement of the inductor segments in this case. In addition, it is conceivable that in sufficiently long furnaces, inductor segments for heating narrower strips are positioned in the furnace before or after inductor segments for wider strips. With an embodiment of this type, the corresponding inductor segments may be switched on and the others may be switched off, for the treatment of wider strips, for example. Therefore, strips of two strip width ranges may be treated in one furnace.

The device according to the present invention may be provided for the purpose of heating strips having a width of at least 200 mm.

The device according to the present invention may furthermore be provided for the purpose of heating strips having a width of at most 2000 mm. In this case, in the event strips of different widths are used, the strip width range in a furnace is selected in such a way that the widest strip to be heated is twice or three times as wide as the narrow strip, for example, the width of the narrow strip is 400 mm and that of the widest strip is 800 and/or 1200 mm.

Finally, the device may be used for heating metallic strips made of aluminum, steel, copper, or brass.

In the following part of the description, embodiments of the device according to the present invention are described with reference to 8 figures.

Figure 2:
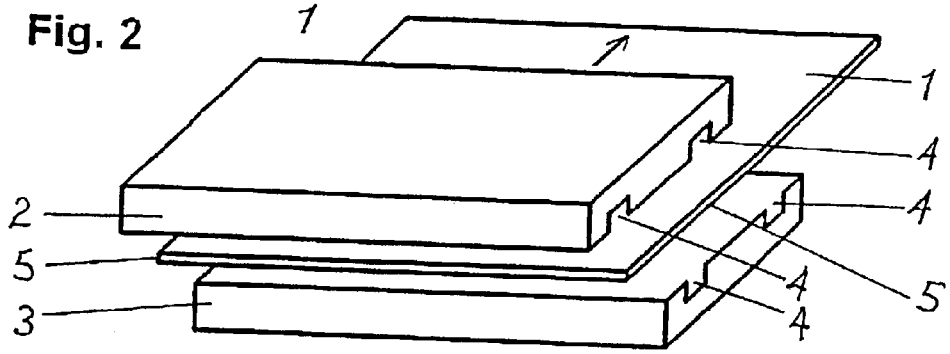
Figure 3:
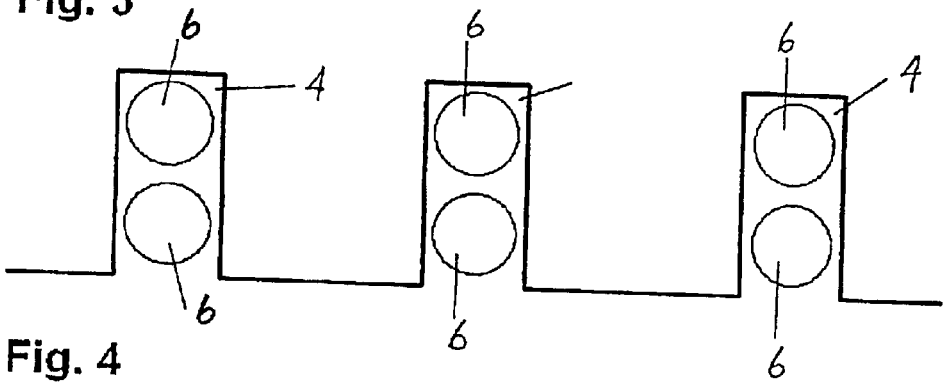
Figure 4:
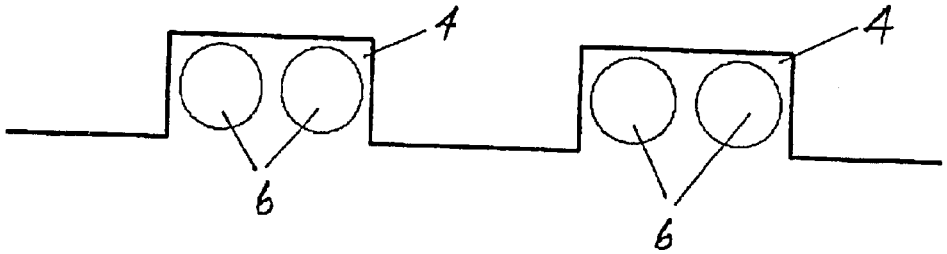
Figure 5:
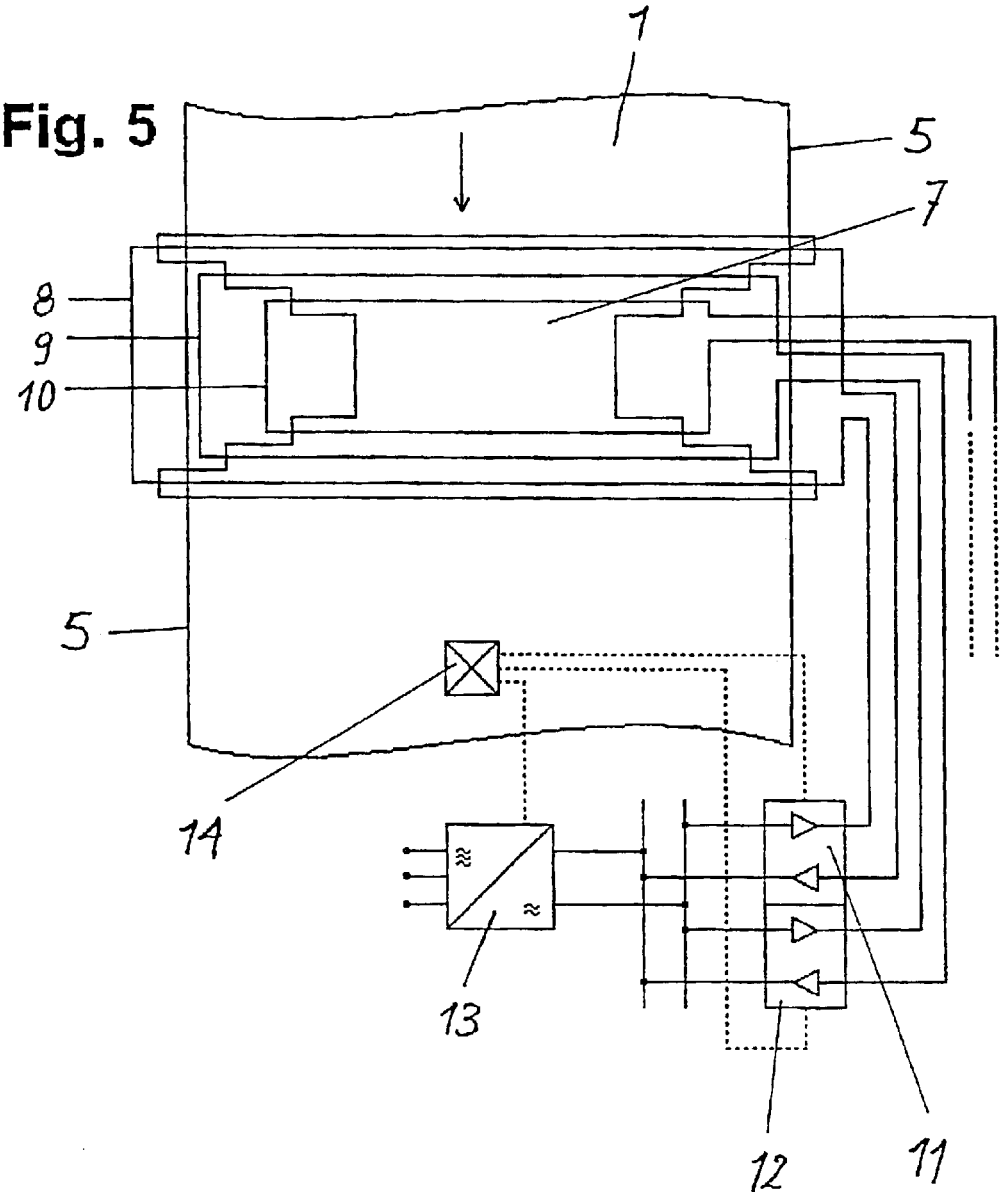
Figure 6:
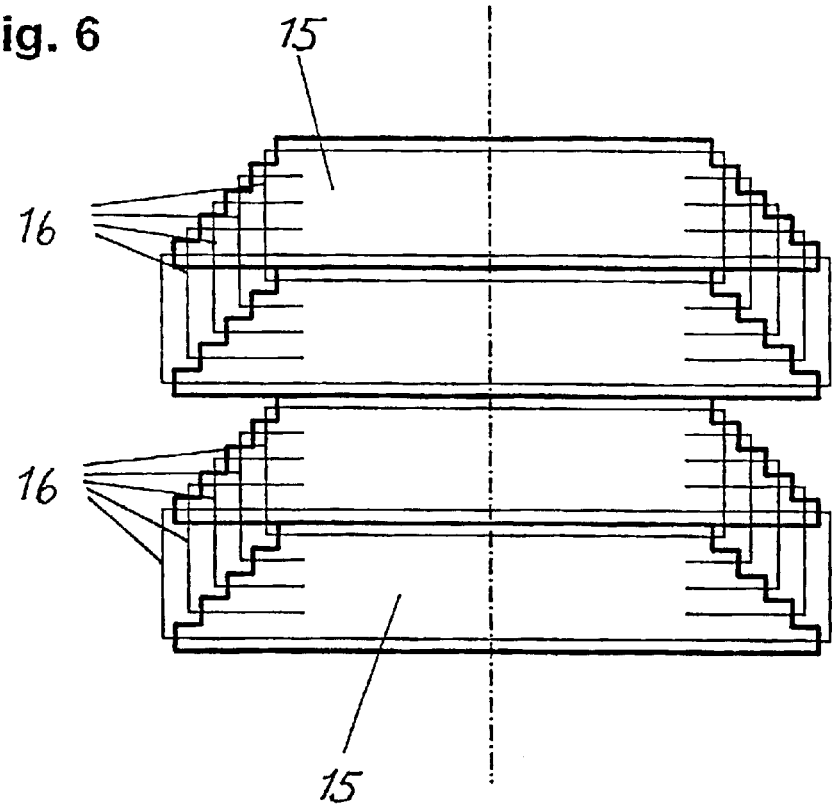
Figure 7:
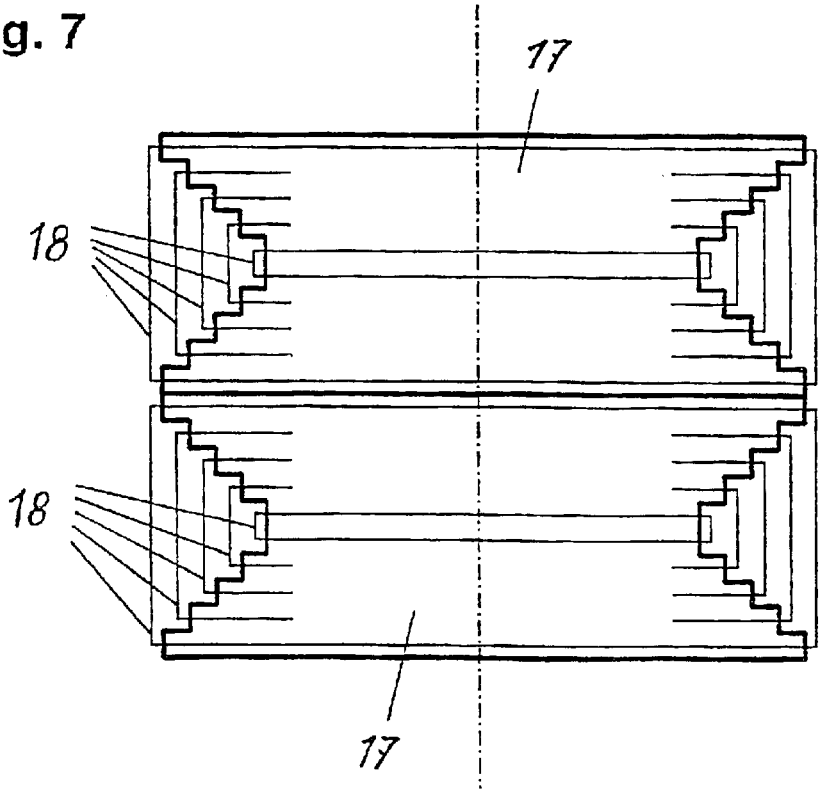
Figure 8:
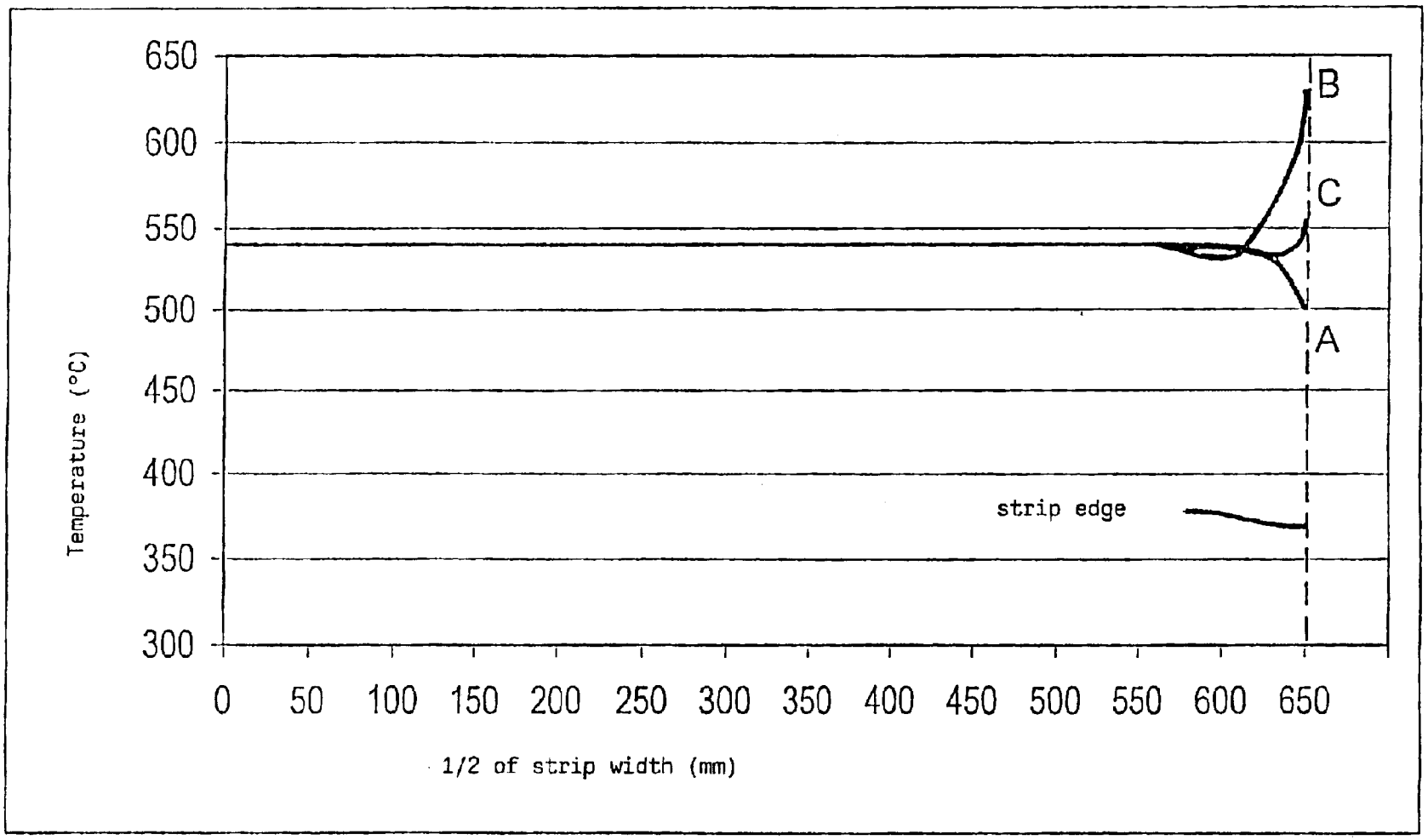

FIG. 1 shows a schematic view of two inductor segments, positioned without offset in relation to one another, with strip to be heated, FIG. 2 shows a schematic view of two inductor segments, positioned with offset in relation to one another, with strip to be heated, FIG. 3 shows a section through coil conductor grooves and coil conductors of an inductor segment, FIG. 4 shows a further section through coil conductor grooves and coil conductors of an inductor segment, FIG. 5 shows a schematic illustration of an inductor segment having electrical connections, a scanner, and strip to be heated, FIG. 6 shows a schematic illustration of two inductor segments positioned one behind the other in the transport direction, FIG. 7 shows a further schematic illustration of two inductor segments positioned one behind the other in the transport direction, and FIG. 8 shows a diagram of the temperature distribution over the strip width of an aluminum band for different coil clockings.

FIG. 1 shows, in a schematic view, a strip 1 and inductor segments 2, 3, which are positioned mirror symmetrically to one another above and below the strip 1. The inductor segments 2, 3 have coil conductor grooves 4 for coil conductors (not shown here). The inductor segments 2, 3 are switched in synchronization. The arrow indicates the transport direction of the strip 1. Multiple inductor segments 2, 3 at a time may be positioned one behind the other in the transport direction of the strip 1. In this case, identically or differently implemented inductor segments may be provided. Using an arrangement of this type, metallic strips of different widths may be annealed. Typical strip widths are between 200 and 2000 mm. Aluminum, steel, or copper strips may be treated, for example.

FIG. 2 shows an alteration of the inductor segment construction known from FIG. 1. The upper inductor segment 2 and the lower inductor segment 3 are positioned offset to one another transversely to the transport direction in such a way that the outer lengthwise edge regions 5 of the strip 1 only have one inductor segment 2, 3 projecting over them at a time. In this way, the temperature profile may blur together slightly over the strip width and thus balance out. Multiple inductor segments 2, 3 at a time may be positioned one behind the other in the transport direction of the strip 1. In this case, all upper and/or lower inductor segments 2, 3 may be offset individually to one another or single inductor segments 2, 3 may be positioned without offset. This offset may be adjusted with low operating expense. In addition, single inductor segments may be removed individually for maintenance purposes.

A detail of an inductor segment 2, 3 having three coil conductor grooves 4 is illustrated schematically in FIG. 3.

Two coil conductors 6 are positioned on top of one another in each of the coil conductor grooves 4. Only providing one coil conductor per coil conductor groove is also conceivable. VA tube having a wall thickness of 0.1–0.2 mm may be used as a coil conductor.

FIG. 4 shows an alteration of the schematic inductor segment detail from FIG. 3. In this case, the two coil conductors 6 are positioned next to one another in the two coil conductor grooves 4, i.e., parallel to a strip (not shown here).

FIG. 5 shows a schematic top view of an inductor segment 7, which is constructed as a coil composite of multiple approximately rectangular coils. In this case, the coils have a shared axis. A strip 1 to be guided along in front of the inductor segment 7 is indicated. An arrow indicates the transport direction of the strip 1. Three coils 8, 9, 10 of the inductor segment 7 are illustrated with the current direction (arrows). A typical coil composite has 3 to 8 coils. The coil 8 has the highest transverse extension and the coil 10 has the lowest transverse extension. The difference of the transverse extension of a coil 8, 9, 10 to the transverse extension of the next smaller or larger coil 8, 9, 10 is 100 mm. The transverse extension of the coil 8 is larger than that of the strip 1. The transverse extensions of the coils 9, 10 are smaller than that of the strip 1. The coil 8 encloses the coil 9 in this case and these two coils 8, 9 enclose the coil 10 in turn. The next smaller nesting coils are not illustrated. The electric circuit is indicated for the coils 8 and 9. This was dispensed with for the coil 10 for reasons of clarity. The coil 8 or 9 is connected via a thyristor switch 11 or 12, respectively, to a shared converter 13. The thyristor switches 11, 12 are used for clocked switching of the coils 8, 9. The frequency and/or duration of the switching operations is variably adjustable for each coil 8, 9. A scanner 14 is positioned in the transport direction of the strip 1 behind the inductor segment 7 to establish the temperature profile over the width of the strip 1. If the strip 1 is irregularly heated due to a coil defect, for example, this fault is detected immediately and may be compensated automatically by a different clocking involving further coils or by offsetting the inductor segment 7 until repair of the coil defect, for example. Operating with two or more converters is conceivable, in order to be variable in output and clocking. The facility output may be, for example, 1050 kW and the frequency may be 500–1000 Hz.

FIG. 6 schematically shows two inductor segments 15 positioned one behind the another in the transport direction (arrow) of a strip (not shown). Both inductor segments 15 are implemented identically and without offset to one another. However, it is also conceivable to position two or more different inductor segments 15 one behind the other with or without offset. A typical facility may include, for example, seven inductor segments each above and below the strip 1 in the transport direction of the strip 1, having an overall length of 7*360 mm=2520 mm. The five coils 16 for each inductor segment 15 are positioned in such a way that the coils 16 are offset in the transport direction of the strip with reducing transverse extension. In this case, offset of one or more of the coils 16 toward the strip is additionally conceivable. The power may be introduced singly into the inductor segments 15. It is conceivable for all of the inductor segments 15 and/or single inductor segments 15 of an inductor to be mounted replaceably.

FIG. 7 schematically shows an alteration of the coil arrangement of the two inductor segments from FIG. 6. In this case, the two inductor segments 17 are implemented identically and without offset to one another. In addition, the inductor segments 17 are positioned, without spacing, one behind the other in the transport direction of a strip (not shown). It is, however, also conceivable to position the inductor segments 17 with spacing. The respective five coils 18 are nested in one another in such a way that smaller coils are surrounded by the larger coils. Of course, a larger and/or smaller number of coils than five is also conceivable. An offset of single coils 18 toward the strip (not shown here) is also conceivable.

Inductor segments 17 of this type may, for example, be used for heating plates having strip widths of 1200 to 1800 mm. If narrower plates are to be heated, then the inductor segments may simply be removed from the device and narrower inductor segments may be inserted into the device.

FIG. 8 shows a diagram of a temperature distribution over the strip width of an aluminum strip of 1 mm height and 1300 mm width annealed at 545° C. In this case, only half of the strip width is illustrated due to the symmetrical temperature distribution over the transverse strip extension. The transport speed of the strip is 30 meters per minute.

Curve A shows a temperature characteristic which is achieved if only coils of one inductor segment, whose transverse extension is significantly smaller than the transverse extension of the strip, are switched on. In this case, only one single coil may also be switched on. I.e., even the switched on coil having the highest transverse extension has a significantly shorter transverse extension, for example, 10 cm shorter, than the transverse extension of the strip in such a case. Coil 10 in FIG. 5 represents a coil of this type. The strip is heated as homogeneously as possible over the strip width. However, the lateral strip edges are annealed at approximately 50° C. lower than the strip middle region.

Curve B shows the temperature characteristic which is achieved if only coils of one inductor segment, whose transverse extension is smaller than the transverse extension of the strip to be heated, are switched on, however, the switched-on coil having the highest transverse extension has approximately the transverse extension of the strip, e.g., a transverse extension shortened by approximately 3 cm. Coil 9 in FIG. 5 represents a coil of this type. The coil 9 is the next largest coil from the coil 10. The strip is heated as homogeneously as possible over the strip width. However, the strip edges have an abrupt temperature increase by 80° C. in comparison to the remaining strip. In this way, significant quality losses may arise in the strip, for example, in the form of warping.

Curve C shows an approximately ideal temperature characteristic over the strip width. This is achieved in that only one coil and/or multiple coils, which have a significantly smaller transverse extension than the transverse extension of the strip, are switched on permanently. This then provides heating corresponding to the curve of curve A. In addition, one coil, which has approximately the transverse extension of the strip, e.g., the coil 9 from FIG. 5, is switched on sometimes. Coils which have a larger transverse extension than the strip are typically not switched on, since they would cause significant overheating of the edge zone. It is conceivable for the two coils 9, 10 from FIG. 5, whose transverse extensions are closest to the transverse extension of the strip, to be switched alternately in a clocked way, while no, one, or multiple shorter coils (not illustrated in FIG. 5) are switched on permanently. In this case the shorter coil 10 may, for example, have clock times twice as long as the larger coil 9. Three or more coils could also be switched in a clocked way. In this case, the coils of the inductor segments positioned opposite and/or one behind the other may be clocked identically or differently. Through optimized clocking of this type, maximum temperature differences over the strip width of plus/minus 5 to 10° C. and therefore uniform strip qualities may be achieved. Clocking may also possibly be dispensed with at specific strip widths, if the desired temperature distribution may also be achieved without clocking due to a good ratio of strip width/transverse extension.

LIST OF REFERENCE NUMBERS

1 strip
2 inductor segment
3 inductor segment
4 coil inductor groove
5 strip lengthwise edge region
6 coil conductor
7 inductor segment
8 coil
9 coil
10 coil
11 thyristor switch
12 thyristor switch
13 converter
14 scanner
15 inductor segment
16 coil
17 inductor segment
18 coil
A diagram curve "overheated strip edge region"
B diagram curve "undercooled strip edge region"
C diagram curve "ideal strip (edge) heating"

What is claimed is:

1. A device for induction heating of metallic strips (1) of differing widths having one multicoil transverse field inductor both above and below the strip (1) to be heated, whose coil axes are positioned vertically to the strip surface, characterized in that, for optimized edge heating of the strips (1), the inductors each comprise at least one inductor segment (2, 3; 7; 15; 17), which is constructed as a coil composite of multiple approximately rectangular coils (8, 9, 10; 16; 18) extending predominantly transversely to the transport direction of the strip (1), the coils (8, 9, 10; 16; 18) having different, stepped transverse extensions and the coil having the highest transverse extension extending at most up to the lateral edges of the widest strip and the coil having the lowest transverse extension extending at most up to the lateral edges of the narrowest strip, each inductor segment (2, 3; 7; 15; 17) is connected to a circuit for defined clocking of its coils (8, 9, 10; 16; 18), and each inductor segment (3; 7; 15; 17) below the strip (1) is assigned an identical inductor segment (2; 7; 15; 17) above the strip (1).

2. The device according to claim 1, characterized in that an inductor comprises multiple inductor segments (2, 3; 7; 15; 17) which are positioned one behind another at intervals in the transport direction of the strip (1).

3. The device according to claim 1, characterized in that each inductor segment (2, 3; 7; 15; 17) is a coil composite of three to eight coils (8, 9, 10; 16; 18).

4. The device according to claim 1, characterized in that the difference of the transverse extension of one coil (8, 9, 10; 16; 18) to the transverse extension of the next smaller or larger coil (8, 9, 10; 16; 18) is at least 50 mm and at most 20 mm.

5. The device according to claim 1, characterized in that a coil composite is constructed from multiple concentric coils (8, 9, 10; 18) of different transverse extensions, the coils (8, 9, 10; 18) having a shared axis.

6. The device according to claim 1, characterized in that the coils (16) of a coil composite are placed offset to one another in the transport direction of the strip (1).

7. The device according to claim 1, characterized in that the coil conductors (6) are positioned on top of one another or next to one another within a conductor groove (4).

8. The device according to claim 1, characterized in that at least two coils (8, 9, 10; 16; 18) per inductor segment (2, 3; 7; 15; 17), selected as a function of the strip width, are switched in a clocked way so that only one coil (8, 9, 10; 16; 18) is switched on at a time.

9. The device according to claim 8, characterized in that the frequency and/or duration of the switching operations is variably adjustable for each coil (8, 9, 10; 16; 18).

10. The device according to claim 1, characterized in that a scanner (14) is provided for establishing the temperature profile over the strip width.

11. The device according to claim 10, characterized in that a circuit is provided for automatic clocking of the selected coils (8, 9, 10; 16; 18) by analyzing the temperature profile established by the scanner (14).

12. The device according to claim 1, characterized in that at least one upper inductor segment (2; 7; 15; 17) is positioned offset transverse to the transport direction of the strip (1) in relation to the assigned lower inductor segment (3; 7; 15; 17).

13. The device according to claim 12, characterized in that the offset between upper and assigned lower inductor segments (2, 3; 7; 15; 17) is variably adjustable.

14. The device according to claim 1, characterized in that at least some of the inductor segments (2, 3; 7; 15; 17) are mounted replaceable in the device.

15. A method of induction heating metallic strips using the device of claim 1, characterized in that the strips (1) have a width of at least 200 mm.

16. A method of induction heating metallic strips using the device of claim 1, characterized in that the strips (1) have a width of at most 2000 mm.

17. A method of induction heating metallic strips using the device of claim 1, characterized in that the metallic strips (1) are made of aluminum, steel, copper or brass.

* * * * *